US006352173B1

(12) United States Patent
Duckworth

(10) Patent No.: US 6,352,173 B1
(45) Date of Patent: Mar. 5, 2002

(54) FEED DEVICE FOR THE GLUE MELT TANK OF AN ADHESIVE DISPENSER

(75) Inventor: David Duckworth, Blackburn (GB)

(73) Assignee: National Starch and Chemical Investment Holding Corporation, New Castle, DE (US)

( * ) Notice: Subject to any disclaimer, the term of this patent is extended or adjusted under 35 U.S.C. 154(b) by 0 days.

(21) Appl. No.: 09/646,202

(22) Filed: Nov. 17, 2000

(30) Foreign Application Priority Data

Mar. 16, 1998 (GB) ..... 9805662

(51) Int. Cl.[7] ..... G07F 11/00
(52) U.S. Cl. ..... 221/82; 221/120
(58) Field of Search ..... 221/6, 9, 69, 75, 221/76, 82, 92, 119, 120, 152, 277, 265

(56) References Cited

U.S. PATENT DOCUMENTS 3,712,507 A * 1/1973 Holt ..... 221/82
3,981,416 A 9/1976 Scholl
5,323,929 A * 6/1994 Marlar ..... 221/82
5,378,089 A 1/1995 Law

FOREIGN PATENT DOCUMENTS

FR 2 579 114 3/1985
FR 2 689 092 3/1992

OTHER PUBLICATIONS

Patent Abstract of Japan Publication #60044074, Aug. 3, 1985, Kikkoman Corp. "Automotive Adhesive Supply Method and Apparatus Therefor".

* cited by examiner

*Primary Examiner*—Kenneth W. Noland
(74) *Attorney, Agent, or Firm*—Cynthia L. Foulke

(57) ABSTRACT

A feed device (10) for feeding blocks (40) of adhesive into a glue melt tank (6), comprising a magazine (12) divided into a plurality of segments (14), each segment (14) adapted to contain a block (40) of hot-melt adhesive; a plate (16) below the magazine (12) having an aperture (18) substantially the size of a segment (14); an side wall (24) surrounding the magazine (12); drive means (37) for moving either the magazine (12) of the plate (16); and indexing means (36) to control the drive means (37) so that each segment (14) is brought in turn into alignment with the aperture (18) in the plate (16).

18 Claims, 2 Drawing Sheets

FEED DEVICE FOR THE GLUE MELT TANK OF AN ADHESIVE DISPENSER

The present invention relates to a dispenser for feeding blocks of adhesive into a glue melt tank.

A conventional method of performing this process involves adding such blocks to the tank by hand. The molten adhesive in the tank is at a high temperature, and the addition of solid blocks to the molten adhesive can cause hot melted adhesive to splash out of the tank, potentially burning the person performing the addition. Clearly, a more remote method of adding the adhesive blocks would be beneficial to the interests of safety.

A previously proposed apparatus for remotely adding adhesive blocks to a glue melt tank comprises a conveyor belt to transport a quantity of adhesive blocks and automatically dispense them into a melt tank. However, such a device takes up considerable space, and is costly, so it is therefore not very practical for use in situations with limited space, a low consumption of adhesive, and/or needing a number of such systems.

Consequently, the present invention aims to provide an adhesive dispenser of a more compact size, and simpler construction to minimise costs.

Accordingly, the present invention is directed to an adhesive dispenser for feeding blocks of adhesive into a glue melt tank, comprising a magazine divided into a plurality of segments, each segment adapted to contain a block of hot-melt adhesive; a plate below the magazine having an aperture substantially the size of a segment; a side wall surrounding the magazine; drive means for moving either the magazine or the plate; and indexing means to control the drive means so that each segment is brought in turn into alignment with the aperture in the plate. This arrangement has the advantage of providing an adhesive dispenser of compact size and simpler inexpensive construction, which may be readily used in conjunction with existing glue melt tanks.

Advantageously the magazine has a carousel structure with radial segments. This has the advantage that the device is considerably more compact and the magazine only has to be supported in one place. Also it allows simple rotational movement to dispense the blocks.

In a preferred embodiment the drive means comprise an axel which rotates either the plate or the magazine, and a drive system attached to the axel.

Advantageously, the drive system is a pneumatic cylinder.

Preferably the plate is fixed and the magazine is movable. Alternatively, the magazine is fixed and the plate is movable. A movable magazine is especially advantageous as the drive means can be mounted below the plate, and hence not interfering with loading of the magazine, and the adhesive blocks also originate from one position.

In a preferred embodiment, the dispenser is further equipped with a level sensor to indicate the level of adhesive in the tank. This has the advantage that the dispenser monitors the level of adhesive in the tank, ensuring that it will not accidently become empty.

Advantageously the level sensor triggers the indexing means to add more blocks. Thus more adhesive blocks are fed to the tank, and the level of adhesive in the tank is maintained at constant level.

Advantageously, the level sensor is equipped with a timer. The operator of the dispenser can therefore readily be informed if the level of adhesive in the melt tank becomes static, which could indicate a malfunction of the dispenser.

Preferably the timer is equipped with an alarm which is set off when a predetermined level of adhesive has been reached or has been maintained for a predetermined period of time. This situation occurs when the dispenser is empty and unable to feed further blocks to the melt tank. The alarm is therefore advantageous in that the operator is made aware that the dispenser requires more adhesive blocks and can attend to this, so that the apparatus using the adhesive is kept operational.

Alternatively, the indexing means is equipped with a counter to indicate the number of adhesive blocks dispensed. The operator can therefore readily be provided with information regarding the number of adhesive blocks consumed.

Preferably the counter is equipped with an alarm which is set off when the adhesive dispenser approaches or reaches an empty state. This provides the advantage that the operator is warned that the dispenser requires more adhesive blocks.

In a preferred embodiment, a removable lid closes the top of the adhesive dispenser. This arrangement provides a barrier between the operator and the molten adhesive, and consequently reduces the possibility of burns, and reduces the risk of extraneous objects being introduced into the dispenser.

Preferably fixing means are provided to allow the lid to be secured in the closed position. The lid cannot therefore be accidently knocked off the dispenser, or removed by unauthorised personnel.

Advantageously the lid or fixing means incorporate a switch coupled to the indexing means which stops the drive means when the lid is open. This arrangement is greatly advantageous in terms of safety, since it means that the dispenser is rendered inoperable if the lid is not in the closed position, so the dispenser cannot be used without a lid, nor can it be filled whilst it is working.

Advantageously, a number of carousels and plates are stacked alternately one above the other and linked with an extended axel. The dispenser can hence be configured to hold as many adhesive blocks as meet the requirements of the adhesive consumer, for instance for the length of a full shift or day.

Additionally, the segments of the magazine and the aperture in the plate can both be adapted to accommodate more than one adhesive block. Therefore, a greater quantity of adhesive can be delivered to the melt tank at one time.

An example of an adhesive dispenser made in accordance with the present invention will now be described, with reference to the accompanying drawings, in which.

Figure 1:
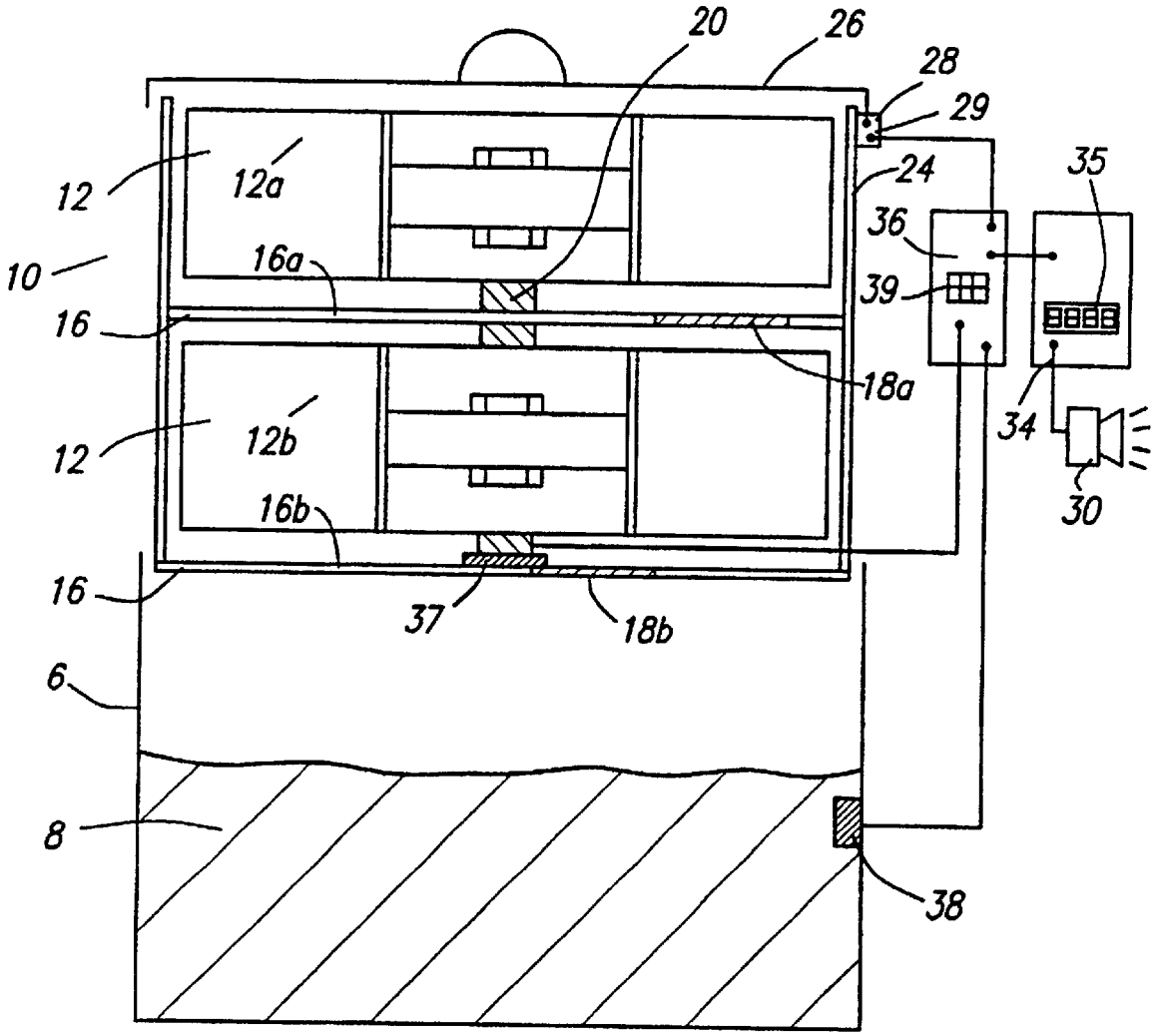
FIG. 1 shows a vertical cross section of such an adhesive dispenser, positioned above a glue melt tank.
Figure 2:
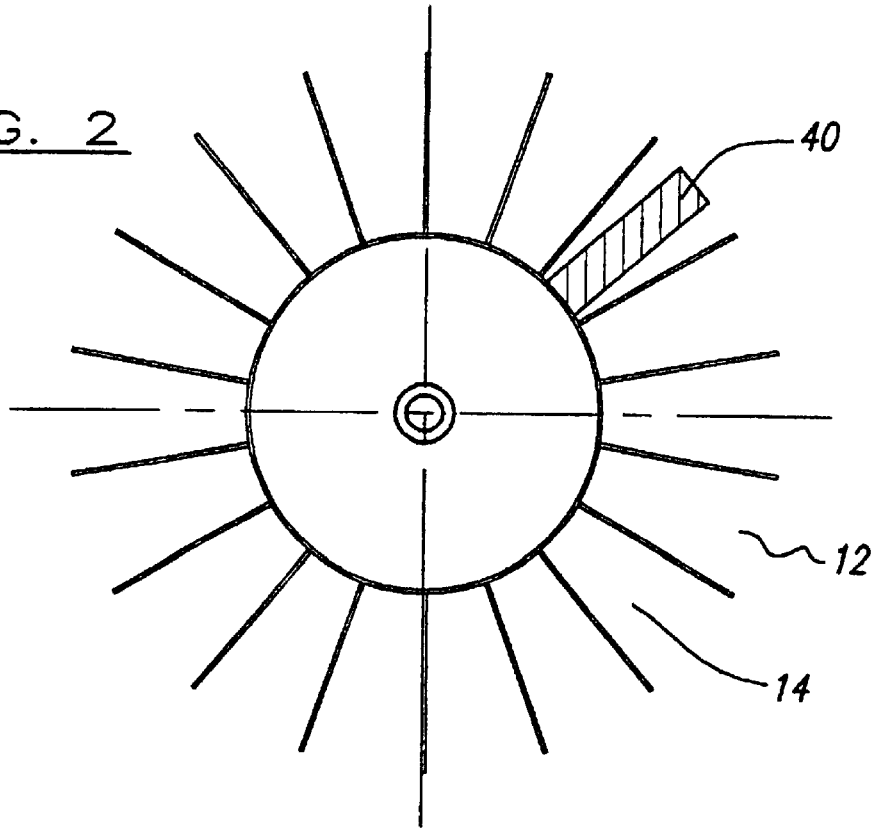
FIG. 2 shows a top view of a carousel.
Figure 3:
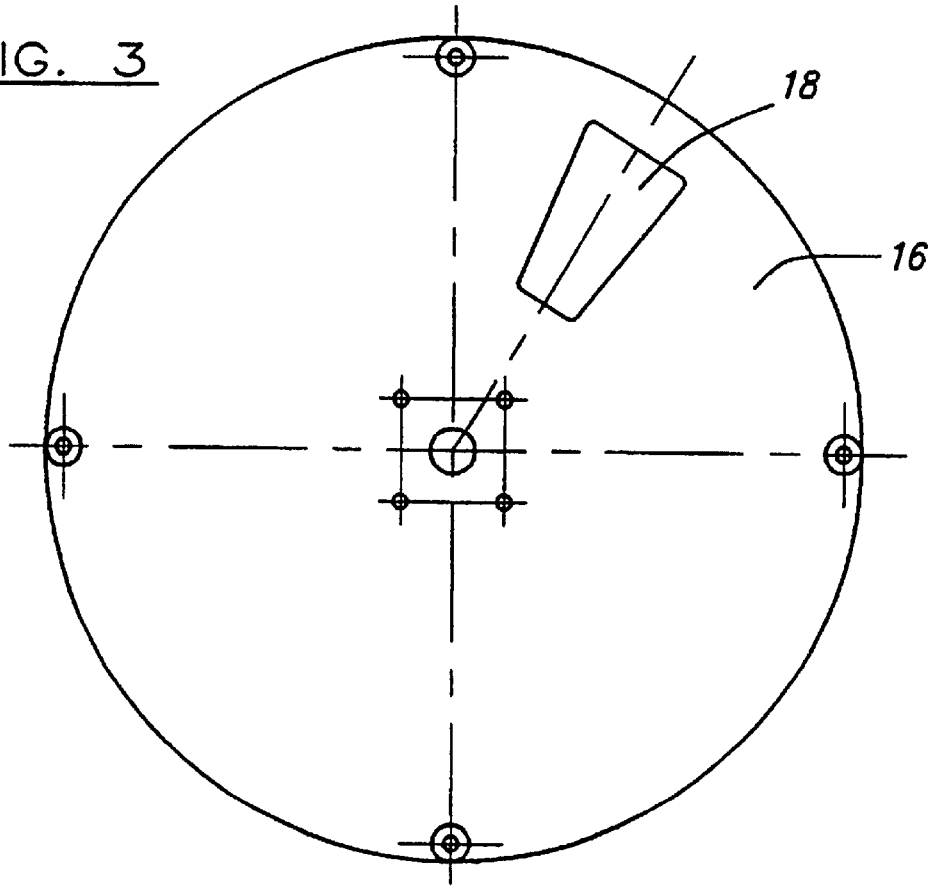
FIG. 3 shows a top view of a plate.

An adhesive dispenser 10 is positioned above a melt tank 6, containing molten adhesive 8. The adhesive dispenser 10 has a side wall 24 surrounding one or more magazines which are in the form of carousels 12. The adhesive dispenser 10 illustrated in FIG. 1 is provided with two carousels 12, an upper carousel 12*a* and a lower carousel 12*b*. Each carousel 12, which is open top and bottom, is divided into a plurality of radial segments 14, each designed to accommodate a block of adhesive 40. Plates 16 are positioned below respective carousels 12. Each plate 16 is provided with an aperture 18 of substantially the same size as a segment 14 of the carousel 12. An axel 20 extends upwardly through the plates 16, and the carousels 12. A pneumatic cylinder 37 rotates the axel 20, and thereby rotates the carousels 12 or the plates 16. In the embodiment described herein, the carousels 12 are rotated at the same speed by the axel 20 and the plates 16 are fixed. The pneumatic cylinder 37 is controlled by indexing means 36.

A removable lid 26 is provided to close the top of the adhesive dispenser 10. A fixing means 28 cooperates with the lid 26 so that the lid 26 may be secured in the closed position. The lid 26 is equipped with a switch 29, which activates the indexing means 36 when the lid 26 is closed.

A level sensor 38 is positioned in the melt tank 6 to detect the level of molten adhesive 8 in the tank 6. A timer 34 is also coupled to the indexing means 36. The timer 34 is connected to an alarm 30.

To operate the adhesive dispenser 10, it is first necessary to fill it with adhesive blocks 40. The lid 26 is removed, and adhesive blocks 40 are placed in each segment 14 of the upper carousel 12*a*. The upper carousel 12*a* is then rotated once, and the adhesive blocks 40 drop one by one into the corresponding positions in the lower carousel 12*b*, as each segment 14 in the upper carousel 12*a* comes in turn into alignment with the aperture 18*a* in the upper plate 16*a*. Thus the lower carousel 12*b* is filled with adhesive blocks 40. The upper carousel 12*a* is then again filled with adhesive blocks. The segment 14 corresponding to the aperture 18*b* in the lower plate 16*b* is left vacant.

The lid 26 is positioned over the adhesive dispenser 10, and is secured in the closed position by use of the fixing means 28. The switch 29 incorporated in the lid 26 enables the indexing means 36 when the lid 26 is in place. Thus the adhesive dispenser 10 can only be operated when the lid 26 is locked shut, thereby enhancing the safety characteristics of the adhesive dispenser 10.

The level sensor 38 positioned in the melt tank 6 monitors the level of molten adhesive 8 in the melt tank. As the molten adhesive 8 is used up, its level within the melt tank 6 drops. When the level drops to a predetermined level, the level sensor 38 detects this state and transmits a signal to the indexing means 36. When the level signal is received, the indexing means 36 rotates the carousels 12 by one segment 14. Thus an adhesive block 40 in the lower carousel 12*b* is brought into alignment with the aperture 18*b* in the lower plate 16*b*, and drops through the aperture 18*b* into the melt tank 6. The aperture 18*a* in the upper plate 16*a* is arranged to be one segment's place away from the aperture 18*b* in the lower plate 16*b*. Thus, after rotation of the carousels 12, an adhesive block 40 is free to drop through the aperture 18*a* in the upper plate 16*a* into the vacant segment 14 in the lower carousel 12*b* previously positioned over the aperture 18*b* in the lower plate 16*b*. Thus, as the carousels 12 rotate, the adhesive blocks 40 in the lower carousel 12*b* are fed into the melt tank 6, and the lower carousel 12*b* is replenished with adhesive blocks 40 fed from the upper carousel 12*a*. An adhesive dispenser 10 with a greater number of carousels 12 works in a similar fashion, so that each carousel 12 replenishes the carousel 12 below, and all the adhesive blocks 40 move in turn from the top of the adhesive dispenser 10 to the bottom, before being fed into the melt tank 6.

The timer 34 linked to the indexing means 36 monitors the length of time the adhesive level is low in the melt tank 6. If this exceeds a predetermined period of time, the alarm 30 is triggered to indicate that the adhesive dispenser 10 needs to be refilled with adhesive blocks 40.

Further embodiments of such an adhesive dispenser can be envisaged. For example, the carousel can be held in a fixed position whilst the plate is rotated by the axel. A dispenser embodied in this way performs exactly as the embodiment described herein above.

Additionally, the carousel segments and the apertures in the plate can be enlarged to accommodate more than one adhesive block, thus allowing more than one adhesive block to be fed into the adhesive tank at a time. Alternatively, the same result can be achieved in a dispenser with a multiplicity of carousels and plates by arranging the apertures in the plates to be coincident vertically so that an adhesive block from each carousel is fed into the melt tank each time the carousels are rotated by one segment.

Also the magazine may have a simple elongate structure and move backwards and forwards across the melt tank.

What is claimed is:

1. An adhesive dispenser for feeding blocks of adhesive into a glue melt tank, comprising a magazine divided into a plurality of segments, each segment adapted to contain a block of hot-melt adhesive; a plate below the magazine having an aperture substantially the size of a segment; a side wall surrounding the magazine; drive means for moving either the magazine or the plate; and indexing means to control the drive means so that each segment is brought in turn into alignment with the aperture in the plate.

2. An adhesive dispenser according to claim 1, in which the magazine has a carousel structure with radial segments.

3. An adhesive dispenser according to claim 2, in which the drive means comprise an axel which rotates either the plate or the magazine, and a drive system attached to the axel.

4. An adhesive dispenser according to claim 3, in which the drive system is a pneumatic cylinder.

5. An adhesive dispenser according to claim 1, in which the plate is fixed and the magazine is movable.

6. An adhesive dispenser according to claim 1, in which the magazine is fixed and the plate is movable.

7. An adhesive dispenser according to claim 1, in which the dispenser is further equipped with a level sensor to indicate the level of adhesive in the tank.

8. An adhesive dispenser according to claim 7, in which the level sensor triggers the indexing means to add more blocks.

9. An adhesive dispenser according to claim 7, in which the level sensor is equipped with a timer.

10. An adhesive dispenser according to claim 9, in which the timer is equipped with an alarm which is set off when a predetermined level of adhesive has been reached or has been maintained for a predetermined period of time.

11. An adhesive dispenser according to claim 1, in which the indexing means is equipped with a counter to indicate the number of adhesive blocks dispensed.

12. An adhesive dispenser according to claim 11, in which the counter is equipped with an alarm which is set off when the adhesive dispenser approaches or reaches an empty state.

13. An adhesive dispenser according to claim 1, in which a removable lid closes the top of the adhesive dispenser.

14. An adhesive dispenser according to claim 13, in which fixing means are provided to allow the lid to be secured in the closed position.

15. An adhesive dispenser according to claim 13, in which the lid or incorporate a switch coupled to the indexing means which stops the drive means when the lid is open.

16. An adhesive dispenser according to claim 2, in which a number of carousels and plates are stacked alternately one above the other and linked with an extended axel.

17. An adhesive dispenser according to claim 1, in which the segments of the magazine and the aperture in the plate are adapted to accommodate more than one adhesive block.

18. An adhesive dispenser according to claim 14, in which the fixing means incorporate a switch coupled to the indexing means which stops the drive means when the lid is open.

* * * * *